US006925941B2

(12) United States Patent
Bengoa Saez De Cortazar

(10) Patent No.: US 6,925,941 B2
(45) Date of Patent: Aug. 9, 2005

(54) ELEVATED TRAIN

(76) Inventor: Domingo Bengoa Saez De Cortazar, Portal de Villaral 15-5° Izq., E-01002 Vitoria-Gasteiz, Alava (ES)

( * ) Notice: Subject to any disclaimer, the term of this patent is extended or adjusted under 35 U.S.C. 154(b) by 0 days.

(21) Appl. No.: 10/473,558

(22) PCT Filed: Mar. 22, 2002

(86) PCT No.: PCT/ES02/00149

§ 371 (c)(1),
(2), (4) Date: Nov. 21, 2003

(87) PCT Pub. No.: WO02/079013

PCT Pub. Date: Oct. 10, 2002

(65) Prior Publication Data

US 2004/0112245 A1 Jun. 17, 2004

(30) Foreign Application Priority Data

Mar. 29, 2001 (ES) ..... P 200100735

(51) Int. Cl.[7] ..... E01B 25/00

(52) U.S. Cl. ..... 104/123; 104/122; 104/130.04; 104/130.06

(58) Field of Search ..... 104/123, 124, 104/27, 28, 122, 130.04, 102, 118, 130.06, 130.01

(56) References Cited

U.S. PATENT DOCUMENTS 1,340,962 A * 5/1920 Lane ..... 104/122
3,457,876 A * 7/1969 Holden ..... 104/89
3,783,792 A 1/1974 Cullom
4,706,782 A 11/1987 Spoeler et al.
5,359,941 A * 11/1994 DeLorean ..... 105/73

FOREIGN PATENT DOCUMENTS

| | | |
|---|---|---|
| DE | 26 04 534 | 8/1977 |
| DE | 32 41 744 | 5/1984 |
| DE | 41 12 827 A1 | 10/1992 |
| EP | 0 016 452 | 3/1980 |
| EP | 0 255 798 | 2/1988 |
| ES | 2 156 531 | 6/2001 |
| FR | 2 666 778 | 3/1992 |
| GB | 1166109 | 10/1969 |
| GB | 2305645 | 4/1997 |

* cited by examiner

*Primary Examiner*—Mark T. Le
(74) *Attorney, Agent, or Firm*—Ostrolenk, Faber, Gerb & Soffen, LLP

(57) ABSTRACT

Elevated train comprised of one or more wagons (1) that move suspended from a rail (2) or the like. This rail is provided at the train stops with at least two transverse gaps that determine a segment (5) from which said train is suspended, with this segment in turn suspended from elevation device (7) that allow its displacement in a vertical sense together with said train between an upper position for circulation and a bottom one in which it rests on or is next to the ground.

8 Claims, 4 Drawing Sheets

ELEVATED TRAIN

The present invention relates to an elevated train comprised of one or more wagons, which moves suspended from a rail or the like and is specifically intended for transporting passengers in cities.

Elevated trains are a transport system that is particularly applicable for transport inside cities, as its installation does not interfere with surface transport.

Already known are elevated trains that travel and at all times remain at a nearly constant height above the ground, sufficient to allow the movement of vehicles and people under its structure. This system requires building elevated platforms with the corresponding passenger loading and unloading accesses, which results in an increased cost of the structure; furthermore, building platforms with their accesses constitutes an obstacle at street level.

In order to avoid this problem elevated trains are already known comprising one or more wagons that move along a rail and that can also move vertically between extreme positions, a top one in which they are able to travel along the rail, and a bottom one in which the wagon or wagons rest on or are next to the ground, in order to allow entry and exit of passengers from street level.

In this sense can be cited patents EP 016452, GB 1166109, GB 2305645, FR 2666778 and DE 4112827, as well as Spanish Patent application no. 9900140 of the applicant.

In all of the above cases each of the train wagons is provided with a top structure that is connected to the rail for its displacement along it. The wagon or wagons are connected to said structure by a mechanism that allows said wagon to move vertically between the uppermost and lowermost positions. The vertical motion means may consist of hydraulic cylinders, levers, cables, etc.

This system is also expensive, as each wagon of the train must be provided with the upper structure and the elevation means.

The object of the present invention is to eliminate the above-described problems by means of an elevated train that does not constitute an obstacle at street level and which furthermore does not include expensive parts or elements in its construction.

The train of the invention is characterised in that the rail along which the train may travel is provided at the stopping areas for loading and unloading passengers with at least two transverse gaps that determine a segment from which said train is suspended. This segment can be separated from the rest of the rail and is suspended from elevation means that allow its vertical motion, together with the train suspended from said segment, between two end positions, an upper one in which the rail segment constitutes a prolongation of the adjacent segments of the rail, and a bottom one in which the wagon suspended from the rail rests on or is next to the ground, in order to allow loading and unloading passengers at street level.

With the above-described construction the train wagons do not require a supporting structure and elevation means. The wagons will be simply provided with the means to allow their displacement along the rail. At the stopping points provided for loading and unloading passengers the rail includes a separable segment that is suspended from elevation means, with the dimensions of this segment being large enough to allow the wagon or wagons comprising the train to be suspended from it.

With the above-described construction it is only necessary to install elevation means at the points where the train stops.

In this way, the structure or installation of the train is simplified, and in particular the cost of the installation is reduced considerably with respect to the previously cited traditional systems.

The elevation means can be comprised of one or more hydraulic cylinders, which may be complemented by vertical guides.

According to another characteristic of the invention, at points where the train stops to load and unload passengers the installation is provided at the position of the rail segment defined between two consecutive gaps, with a second rail segment, parallel and with the same length. The two segments can move laterally on guides for their mutual substitution in the positions of alignment with the adjacent segments of said rail.

This possibility will allow trains to cross at the stations or stops, as well as allowing a later train to pass.

The characteristics and advantages of the invention will be better understood in view of the following description, made with reference to the accompanying drawings, which show an example of a non-limiting embodiment.

Figure 1:
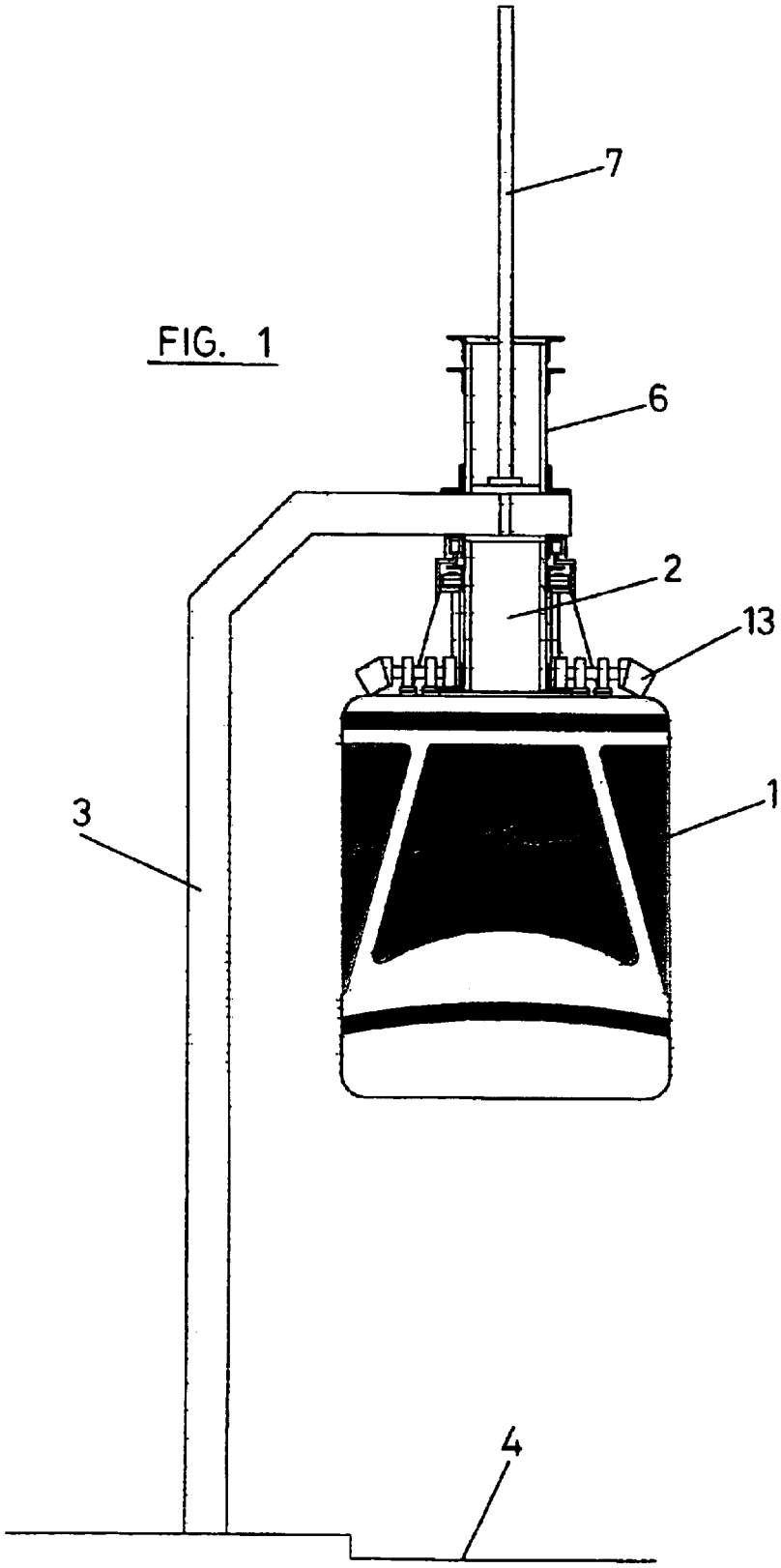
FIG. 1 is a front elevation view of an elevated train constructed according to the invention.
Figure 2:
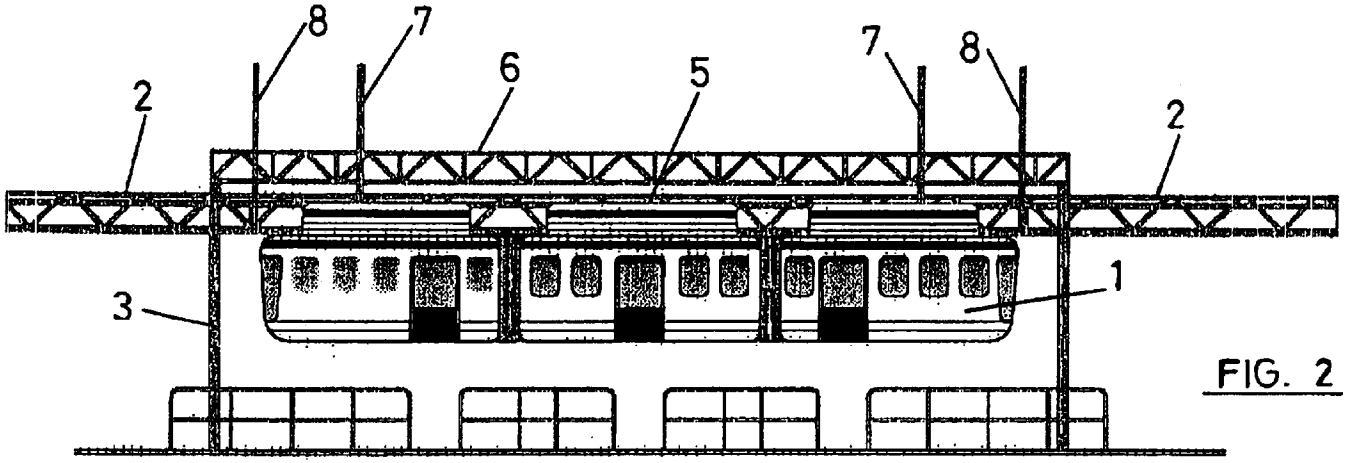
FIG. 2 is a side elevation view of the train of FIG. 1 in an elevated position.

FIGS. 1 and 2 show an elevated train labelled with the number 1 and which can be comprised of one or two wagons, suspended from a rail 2 along which it can move. The rail 2 is mounted on columns or posts 3 with a sufficient height so that the train 1 is not an obstacle to vehicles and people moving along the ground or street 4.

The posts or columns 3 may be of different types and nature, as may the rail 2.

According to the present invention, at the areas where the train stops to load or unload passengers the rail 2 includes an independent segment 5, separated from the rest of the rail 2 by transverse gaps. This segment 5 is suspended from a structure 6 by elevation mechanisms that can consist of hydraulic cylinders 7.

Figure 3:
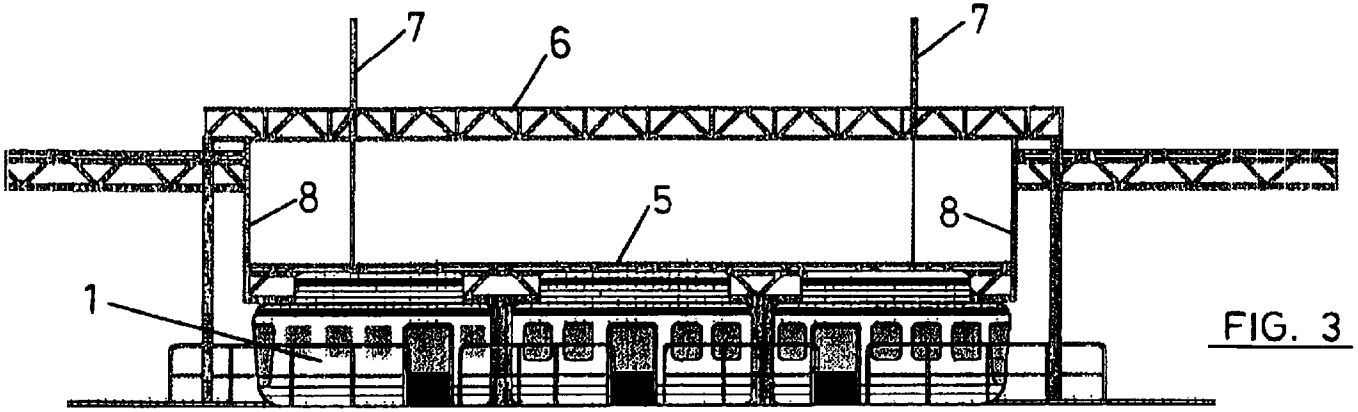
FIG. 3 is a similar view to FIG. 2, with the train in the lowermost position.
Figure 4:
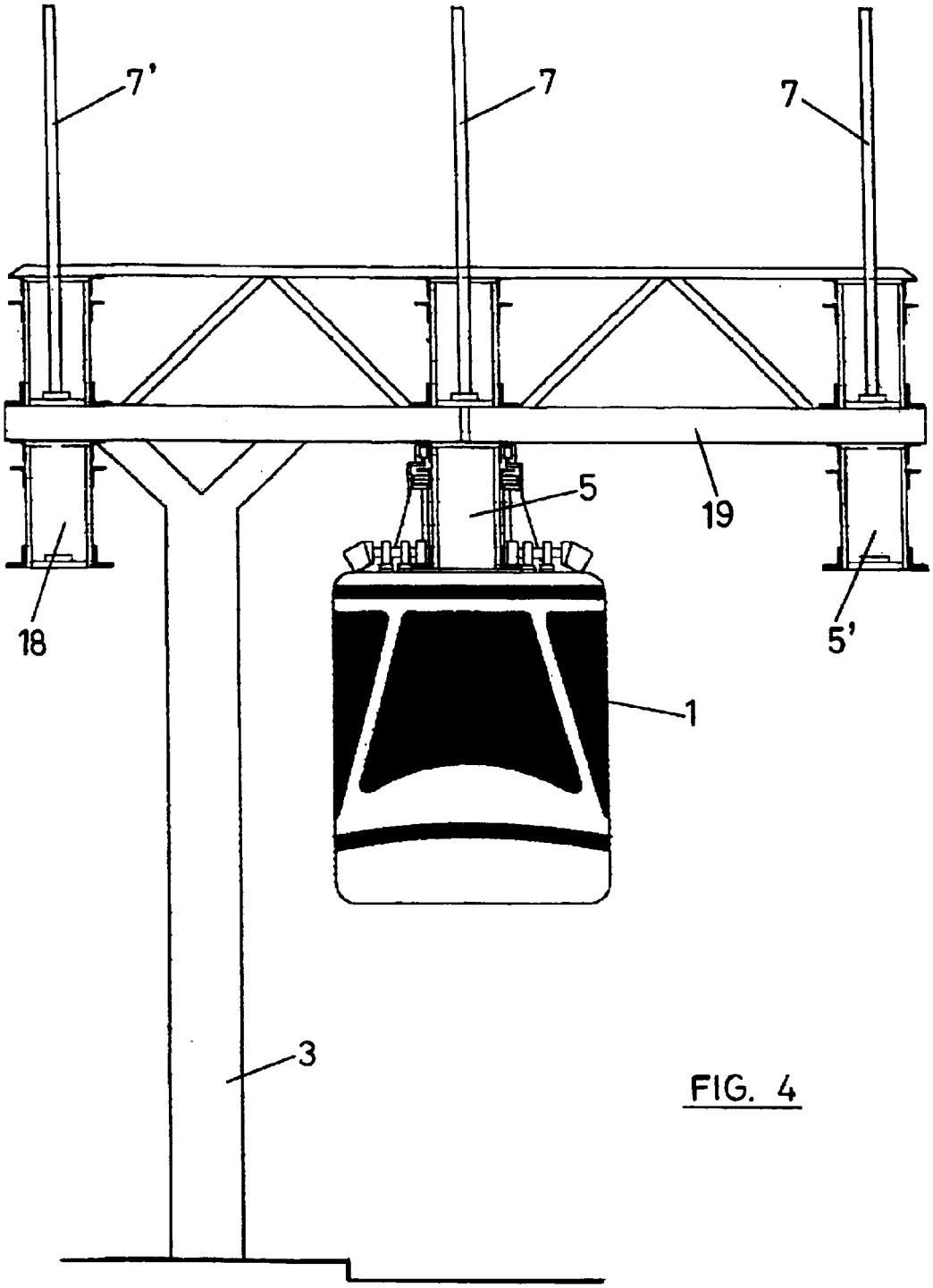
FIG. 4 is a similar view to FIG. 1, showing a possible construction to allow trains to cross and overtake each other.

By means of this elevation mechanism the segment 5 can move vertically between an uppermost position shown in FIG. 2, in which it is placed as a prolongation of the adjacent rail segments, and a bottommost position shown in FIG. 3, in which the wagons 1 rest on or are next to the ground, to allow loading and unloading passengers.

In order to ensure the vertical displacement of the wagons 1, vertical guides 8 may be provided in addition to the cylinders 7.

With the above-described construction when the wagons 1 are in the uppermost position of FIG. 2 they do not represent an obstacle for the motion of vehicles and people on the street, while when they are placed in the position of FIG. 3 they allow a simple loading of passengers, all of this without requiring to build elevated stations and requiring only to install elevation mechanisms at the stops or stations.

Figure 5:
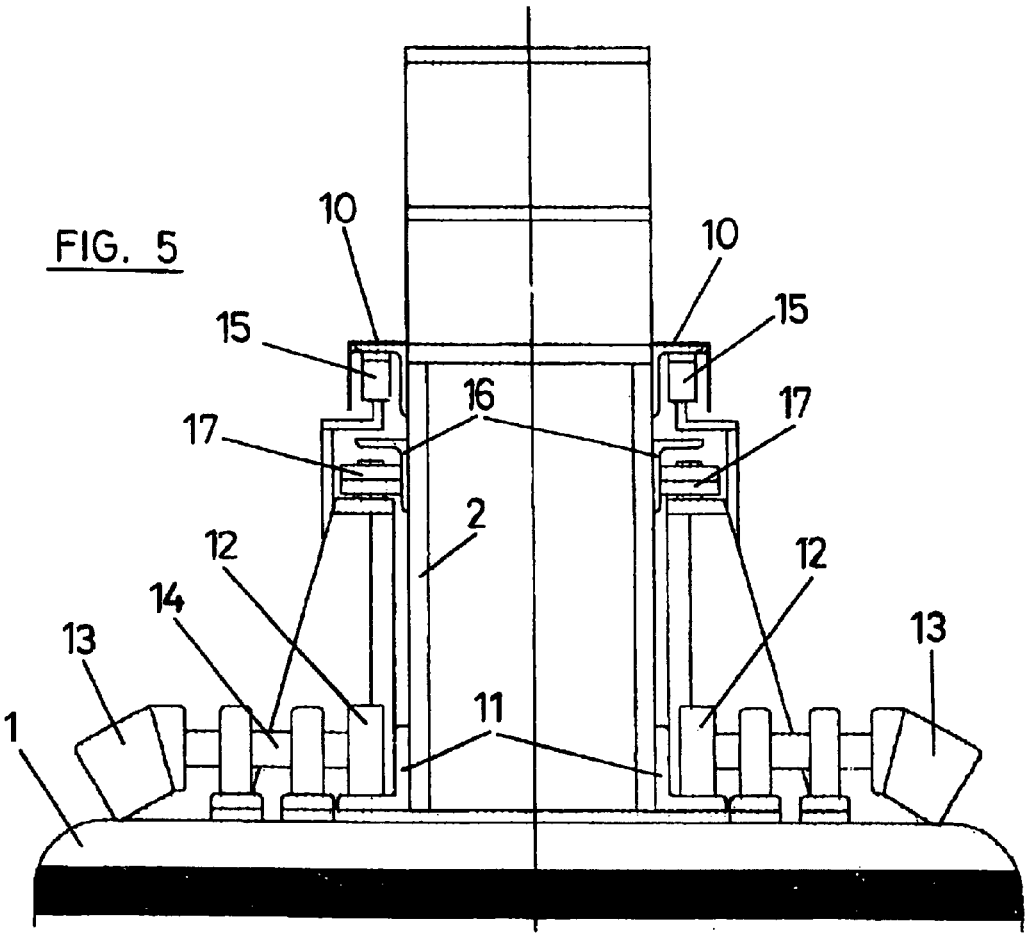
FIG. 5 is a cross section of the rail, with the train suspension and rolling means.

The rail 2 can have a box-girder cross-section as shown in FIG. 5, for lattice structures, and be externally provided with top and bottom angle irons 10 and 11. On top of the latter run wheels 12 for the displacement of the vehicle which can be driven by engines 13 through the corresponding shaft 14. The upper profiles 10 can be used to support electric power lines with which power take-offs 15 make contact. In addition, intermediate auxiliary sections 16 can be provided on which may roll vertical-axle wheels 17 that stop the wagons 1 from swaying.

In order to allow trains to cross and overtake each other, the stops may be provided with an additional rail segment 18 with the same characteristics and length as the segment 5 and parallel to it. Both the segment 5 and the segment 18 of the rail can move transversely on horizontal rails 19.

With this construction, when the train 1 is at a station and another train must cross or overtake it the rail 5, with the suspended wagons 1, is moved to the position 5'. The auxiliary segment 18 is then moved sideways until it occupies the original position of the rail segment 5, so that it determines a prolongation of the adjacent rail segments, in order to allow another train to pass. After the second train has passed the inverse process is followed so that the segment 5 returns to its original position, allowing the wagons 1 to continue their motion.

The segment 18 can also be provided with cylinders 7' to allow the crossing or overtaking train to occupy the bottom-most position of FIG. 3 for loading and unloading passengers.

The rails 2 can adopt any configuration or structure, as can the columns 3. Any system may be used for the motion and electric power connection of the wagons 1 different from the one described, as neither the construction of the rail 2 nor the columns 3 nor the rolling system constitute part of the invention.

What is claimed is:

1. An elevated train suspended from a rail elevated at a height above a ground level, comprising at least one wagon that travels along a route having stations for boarding and/or disembarking of passengers, and having a portion of the rail at a station to define a station segment, a portion of the rail preceding the station segment to define a preceding segment, and a portion of the rail following the station segment to define a following segment, wherein the station segment comprises at least two transverse gaps so as to define a first rail segment, the first rail segment having a length equal to a distance between the preceding segment and the following segment, the train being suspended from the first rail segment when the train is in a station, first elevation means being provided for suspending the train and for allowing the first rail segment together with the train to be displaced in a vertical direction between two extreme positions, the two positions including an upper position in which the first rail segment is located between the preceding segment and the following segment so as to define a continuous rail route, and a bottom position in which the train suspended from the first rail segment rests on or is next to the ground so as to allow boarding and/or disembarking of passengers at ground level, a second rail segment being provided parallel to the first rail segment and having a length equal to the length of the first rail segment, the first rail segment and the second rail segment being configured to move sideways on guides for replacing one another in the upper position and for aligning with the preceding segment and the following segment.

2. The elevated train according to claim 1, wherein the elevation means comprise at least one hydraulic cylinder.

3. The elevated train according to claim 1, wherein the first elevation means further comprise vertical guides.

4. The elevated train according to claim 1, wherein the second rail segment is suspended by second elevation means for allowing the second rail segment to move vertically between the upper position and the bottom position.

5. The elevated train according to claim 2, wherein the first elevation means further comprise vertical guides.

6. The elevated train according to claim 2, wherein the second rail segment is suspended by second elevation means for allowing the second rail segment to move vertically between the upper position and the bottom position.

7. The elevated train according to claim 3, wherein the second rail segment is suspended by second elevation means for allowing the second rail segment to move vertically between the upper position and the bottom position.

8. The elevated train according to claim 5, wherein the second rail segment is suspended by second elevation means for allowing the second rail segment to move vertically between the upper position and the bottom position.

* * * * *